US007147567B2

(12) United States Patent
Yu

(10) Patent No.: US 7,147,567 B2
(45) Date of Patent: Dec. 12, 2006

(54) GOLF TRAINING KIT FOR PLAYING ON A SMALL COURSE

(76) Inventor: Wan Sheng Yu, 4FL. 27 Lane 160, Hsin Sheng S. Road, Sec. 1, Taipei (TW) 100

( * ) Notice: Subject to any disclaimer, the term of this patent is extended or adjusted under 35 U.S.C. 154(b) by 0 days.

(21) Appl. No.: 11/102,693

(22) Filed: Apr. 11, 2005

(65) Prior Publication Data

US 2006/0089205 A1 Apr. 27, 2006

(30) Foreign Application Priority Data

Oct. 27, 2004 (TW) ..... 93132582 A

(51) Int. Cl.
*A63B 69/36* (2006.01)
*A63B 57/00* (2006.01)

(52) U.S. Cl. ..... 473/190; 473/393

(58) Field of Classification Search ..... 473/180–190, 473/393–395

See application file for complete search history.

(56) References Cited

U.S. PATENT DOCUMENTS 1,136,708 A * 4/1915 Osborn ..... 473/189
1,798,140 A * 3/1931 Byers ..... 473/184
2,113,521 A * 4/1938 Torres ..... 273/382
2,737,392 A * 3/1956 Stokes ..... 473/189
4,007,938 A * 2/1977 Guenther ..... 473/188
4,336,940 A * 6/1982 Sprague ..... 473/393
5,145,178 A * 9/1992 Ropars ..... 473/189
5,306,013 A * 4/1994 Germinario ..... 473/182
5,397,130 A * 3/1995 Brown ..... 273/348
5,540,017 A * 7/1996 Eilam et al. ..... 52/118
6,213,672 B1 * 4/2001 Varga ..... 403/109.2

* cited by examiner

*Primary Examiner*—Mark S. Graham

(57) ABSTRACT

Provided is a golf training kit for playing on a small course. The kit comprises a ball mound comprising a seat having a tee, a rope having one end attached to the seat, and a foot member at the other end of the rope; and a target assembly comprising a base assembly of a predetermined height and including a plurality of peripheral openings, a support on a top of the base assembly, and a bell hung under the support. In playing, a person stands on the foot member prior to hitting a ball. The bell rings when struck by the ball driven through the opening. Additionally, there are provided a hollow pole comprising a base segment releasably secured onto the support, and at least one connecting segment releasably connected to the base segment, and a flag attached to the topmost connecting segment.

5 Claims, 5 Drawing Sheets

GOLF TRAINING KIT FOR PLAYING ON A SMALL COURSE

BACKGROUND OF THE INVENTION

1. Field of Invention

The present invention relates to golf training equipment and more particularly to a golf training kit capable of being quickly assembled for playing on a small course.

2. Description of Related Art

Leisure activities are gaining popularity among people as life quality improves throughout the world. Playing golf is one type of such activity because it has the benefits of both sports and recreation. Conventionally, golf is an outdoor game played on a large course. For example, it is typically located in suburbs. A person may take several hours, half day, or even a whole day for playing golf partly due to transportation. This is not ideal for busy people. Moreover, golf equipment including golf club, golf bag, etc. is not cheap. As such, most people think golf is for rich people only not for ordinary people.

Generally speaking, golf is a good game having much recreation and requires skills. Thus, it is desirable to provide a novel golf training kit capable of being quickly assembled for playing on a small course (e.g., garden, a small tract of public land, or park) such that most ordinary people may be able to frequently engage in golf playing by spending only a small amount of money.

SUMMARY OF THE INVENTION

It is therefore an object of the present invention to provide a golf training kit for playing on a small course for playing on a small course (e.g., garden, a small tract of public land, or park) such that most ordinary people may be able to frequently engage in golf playing.

It is another object of the present invention to provide a golf training kit for playing on a small course such that most ordinary people can play golf by spending only a small amount of money.

It is yet another object of the present invention to provide a golf training kit for playing on a small course such that most ordinary people can enjoy the benefits of both sports and recreation of golfing without spending a lot of time in both transportation and playing on a large course.

The above and other objects, features and advantages of the present invention will become apparent from the following detailed description taken with the accompanying drawings.

DETAILED DESCRIPTION OF THE INVENTION

Figure 1:
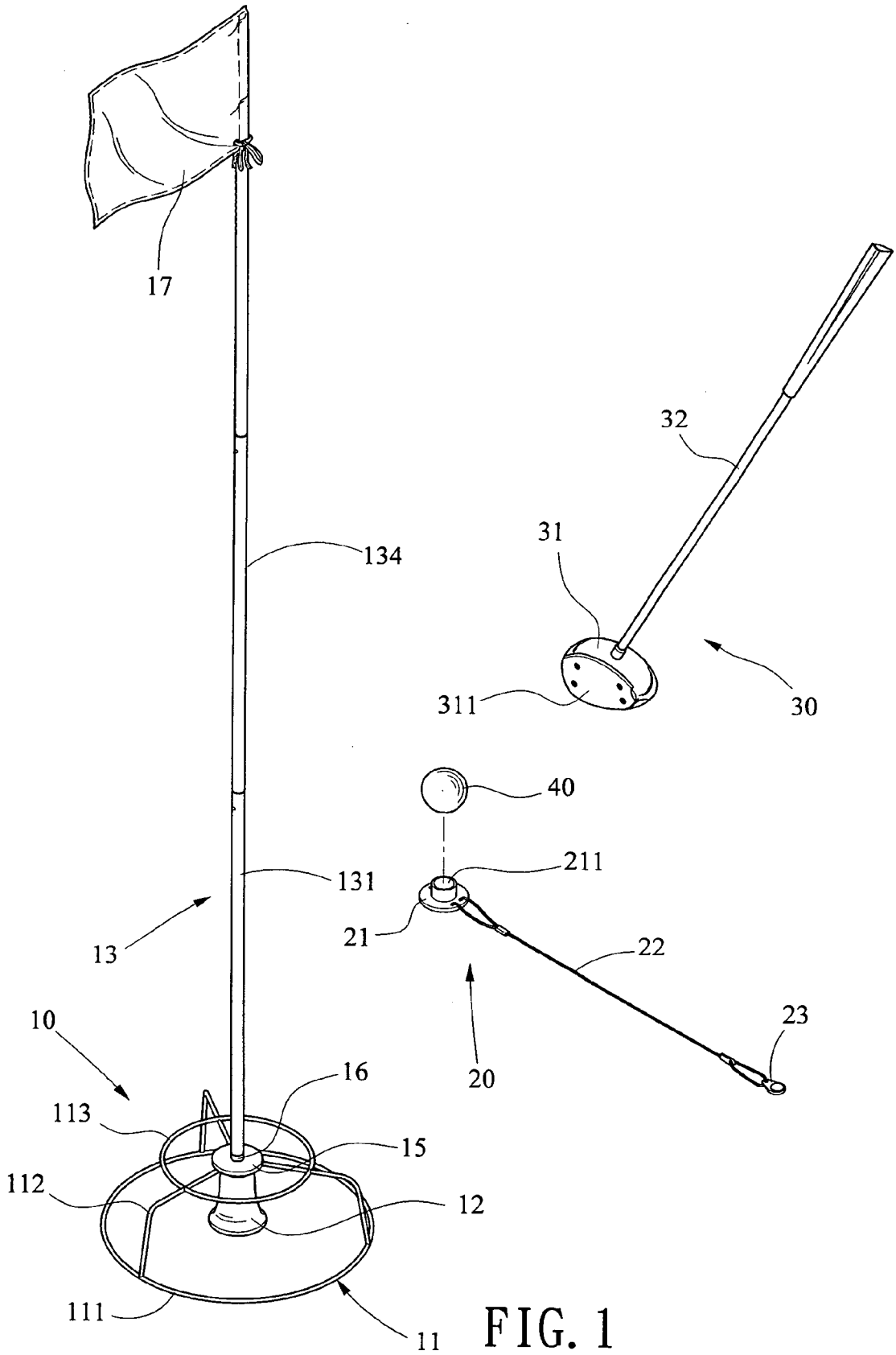
FIG. 1 is a perspective view of a preferred embodiment of golf training kit for playing on a small course according to the invention.
Figure 2:
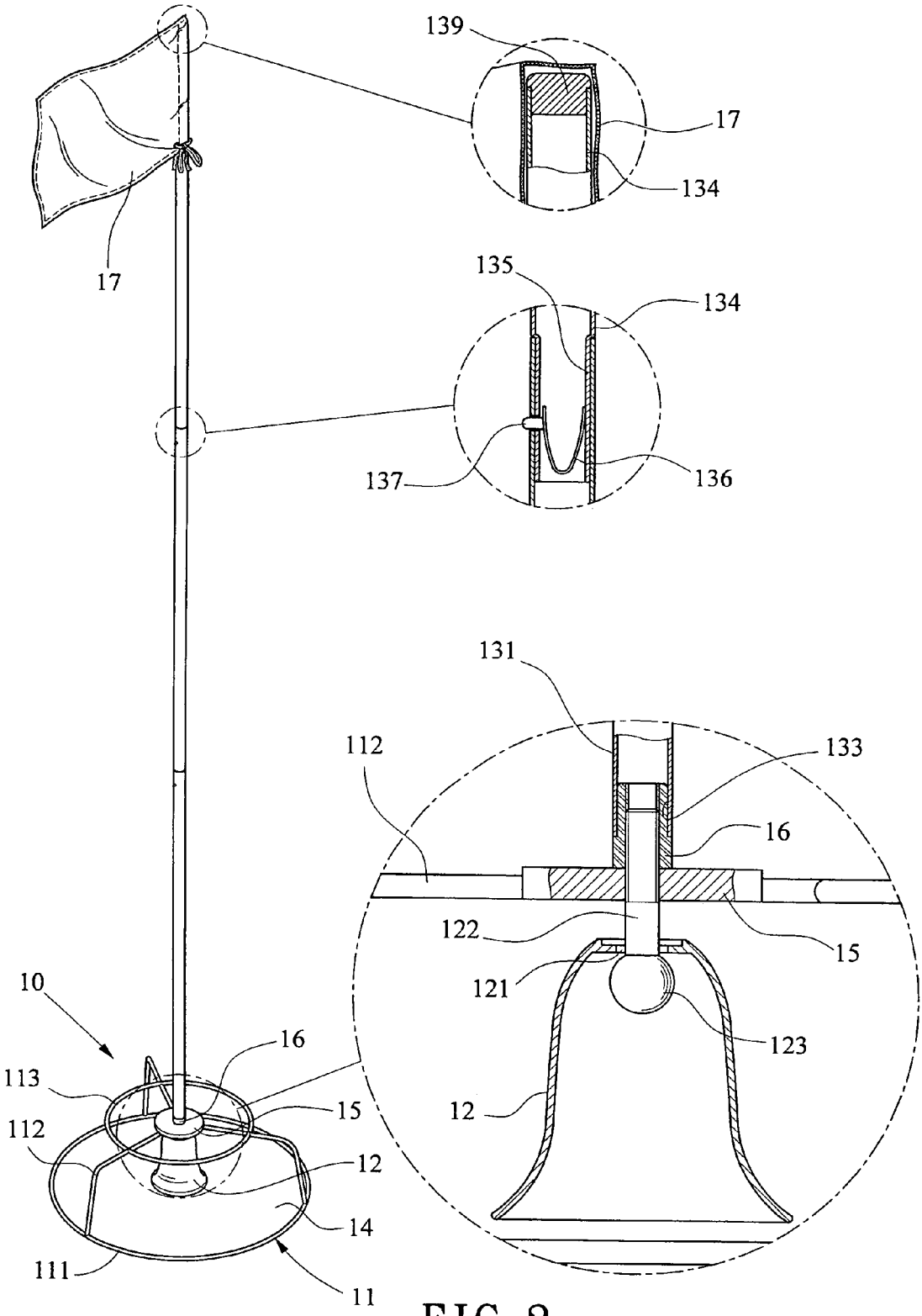
FIG. 2 is a perspective view of the target assembly with its bottom, intermediate, and top portions shown in enlarged sectional views.
Figure 3:
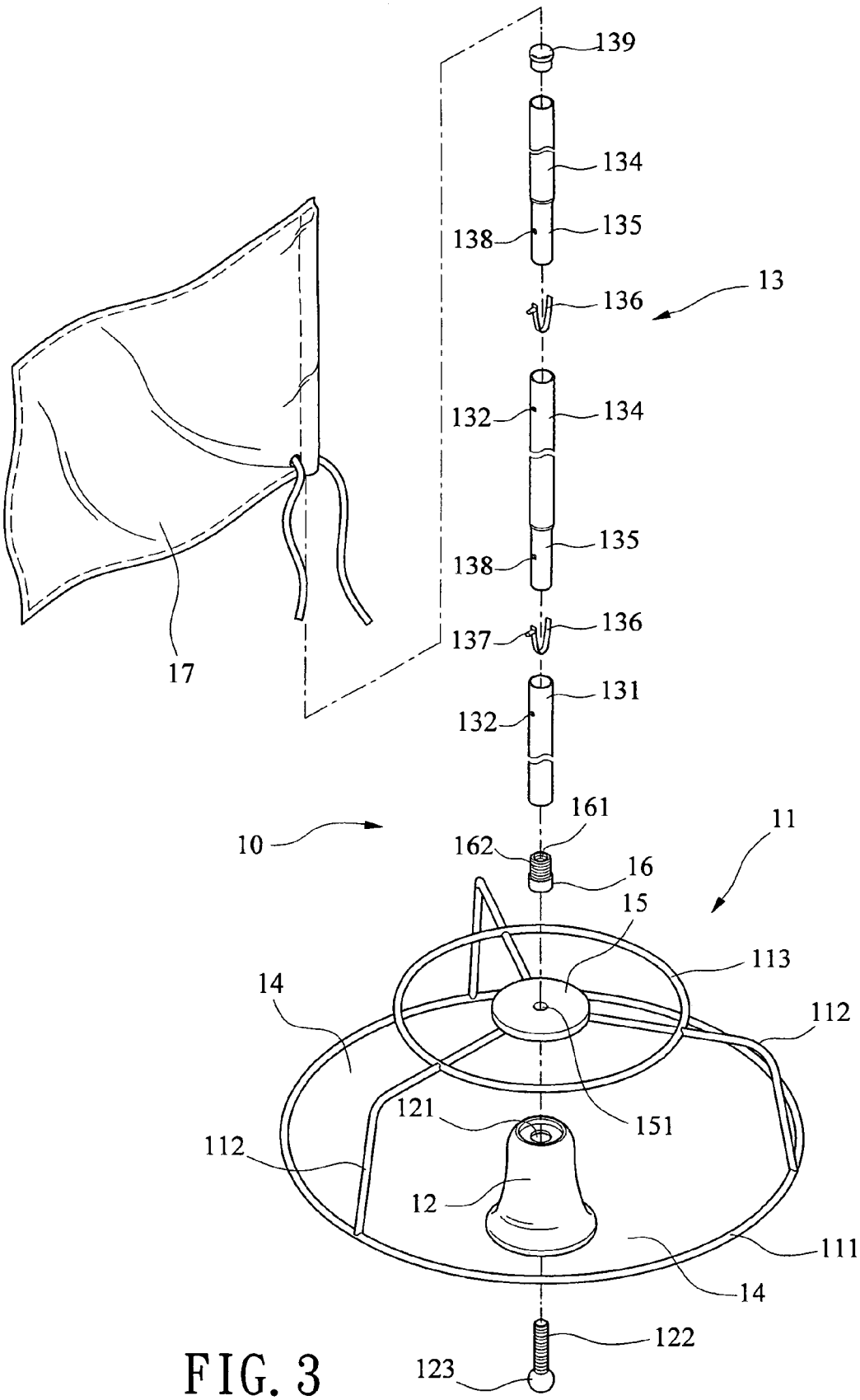
FIG. 3 is an exploded view of the target assembly.

Referring to FIGS. 1, 2, and 3, there is shown a golf training kit in accordance with a preferred embodiment of the invention comprising a target assembly 10, a ball mound 20, and a golf club 30. Each component is discussed in detailed below.

The target assembly 10 comprises a base assembly 11, a target 12, and a hollow pole 13. The base assembly 11 comprises an outer, lower, circular, large frame 111, an inner, upper, circular, small frame 113, and a plurality of (three) equally spaced, bent links 112 interconnected the frames 111 and 113 for defining a plurality of (three) openings 14 each between two adjacent links 112. Note that the frame may have any of other shapes (e.g., square) in other embodiments. A disk-shaped support 15 is formed in a joining point of the links 112 and is surrounded by the small frames 113. The support 15 is disposed above the large frame 111 by a predetermined distance and comprises a through hole 151. The target 12 is implemented as a bell and comprises a top aperture 121 and a threaded shank 122 having a bottom enlargement 123 urged against a bottom of the aperture 121 because the enlargement 123 has a diameter larger than that of the aperture 121 as the shank 122 passed through both the aperture 121 and the hole 151 also because each of the aperture 121 and the hole 151 has a diameter larger than that of the shank 122. A sleeve 16 comprises inner threads 161 threadedly secured to the shank 122, and outer threads 162. The sleeve 16 and the support 15 can be formed integrally in other embodiments. The pole 13 comprises a plurality of segments including a base segment 131 and a plurality of (two) connecting segments 134. Note that the number of the connecting segments 134 can be increased or decreased depending on applications as appreciated by those skilled in the art. The base segment 131 comprises a lower, inner threaded section 133 threadedly secured to the outer threads 162, and a surface hole 132 above the threaded section 133. In the embodiment, the intermediate connecting segment 134 comprises a small lower portion 135, a lower surface hole 138 on the lower portion 135, and an upper surface hole 132 and the upper connecting segment 134 comprises a small lower portion 135 and a lower surface hole 138 on the lower portion 135. Two bent resilient detent members 136 each is adapted to dispose in the lower portion 135. The lower portion 135 of the intermediate connecting segment 134 is snugly fitted in the base segment 131 and the lower portion 135 of the upper connecting segment 134 is snugly fitted in the intermediate connecting segment 134. The resilient detent member 136 has a tab 137 at one end inserted through the holes 138 and 132 for fastening two adjacent segments together. A cap 139 is fitted onto a top of the upper connecting segment 134 and a flag 17 is attached to an upper portion of the upper connecting segment 134. The flag 17 is adapted to show the position of the base assembly 11 or the target 12.

The ball mound 20 comprises a seat 21 having a projected top tee 211 for placing a ball 40 to be driven, a rope 22 having one end attached to the seat 21, and a foot member 23 formed at the other end of the rope 22. The golf club 30 comprises a head 31 having a face 311, and a shaft 32.

Figure 4:
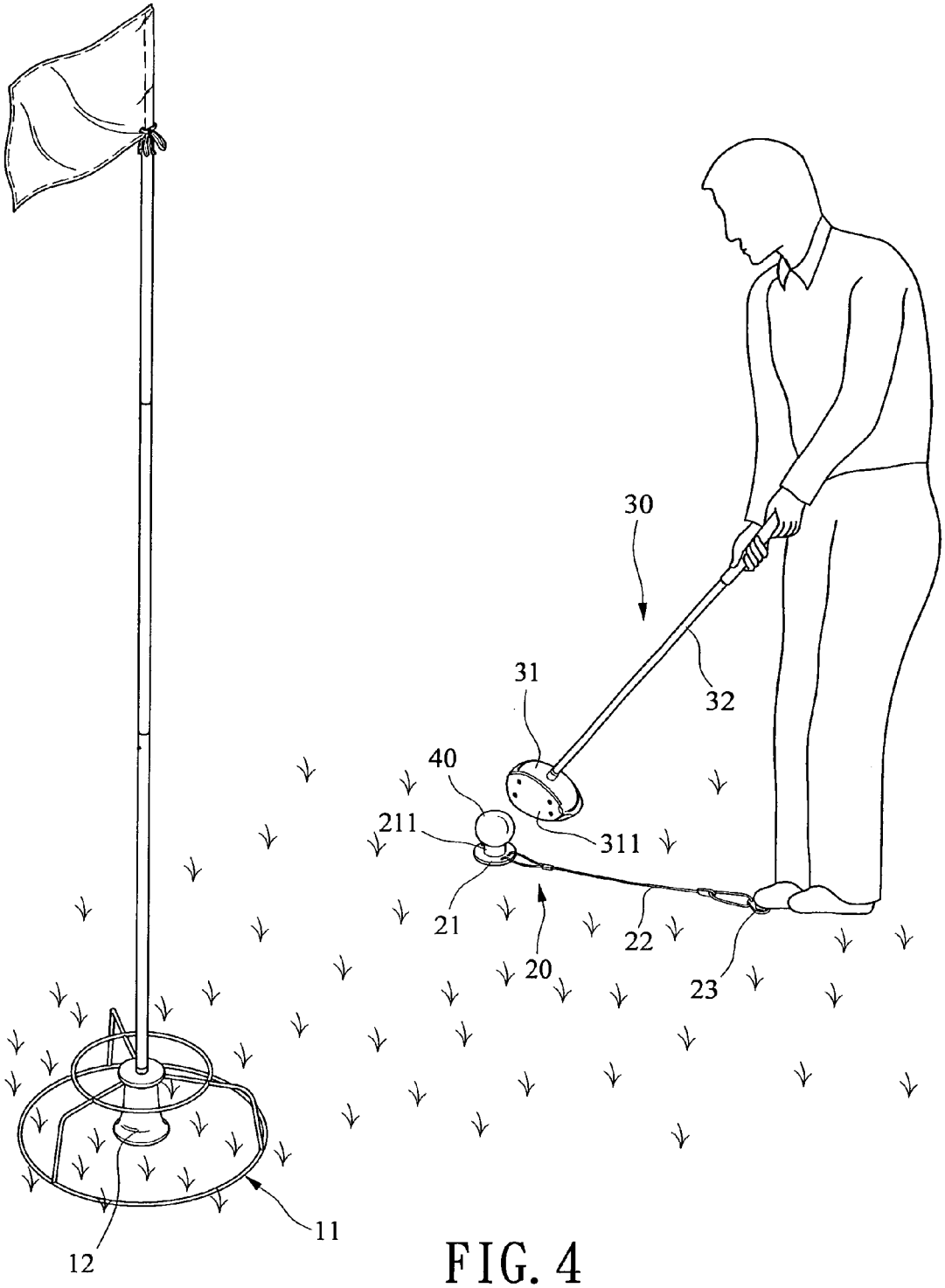
FIG. 4 is an environmental view of the golf training kit being played by a person on a small course.
Figure 5:
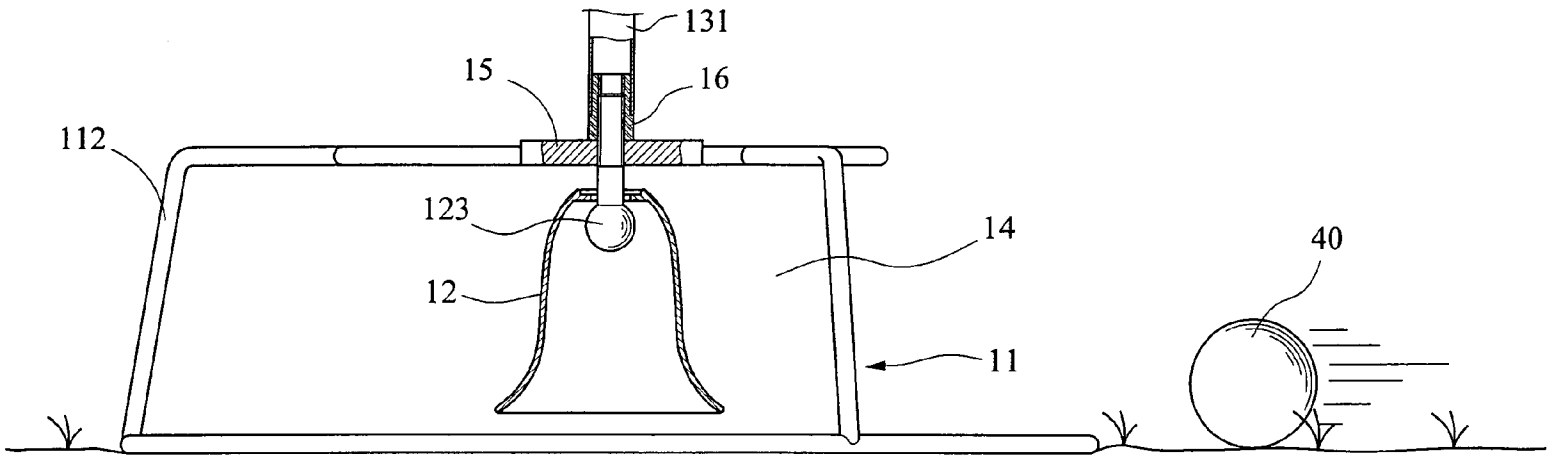
FIGS. 5 and 6 are side views in part section showing a rolling ball about to hit the target and hitting the target respectively.
Figure 6:
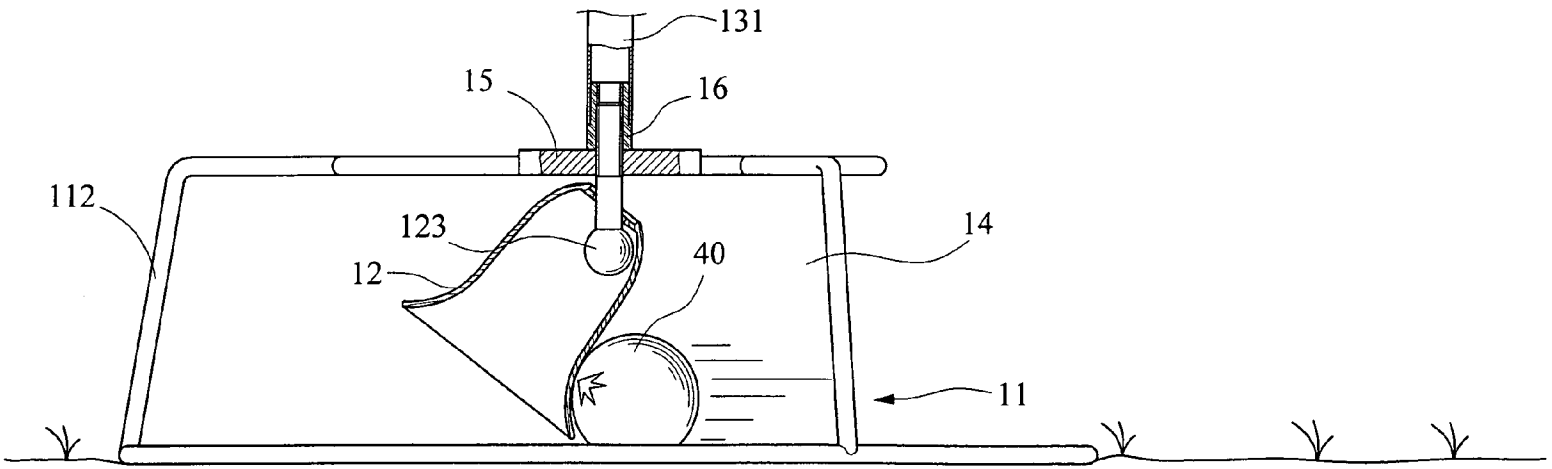

Referring to FIGS. 4, 5, and 6, the golf training kit is designed to enable a person to play on a small course (e.g., garden, a small tract of public land, or park). In playing, the person first places a ball 40 on the tee 211. Next, the person may hold the shaft 32 with the face 311 aimed at the ball 40 and the eyes aimed at the target 12 and stand on the foot member 23 so as to prevent the ball mound 20 from moving arbitrary after hitting the ball 40 by swinging the golf club 30. The person may look at the flag 17 for hitting direction adjustment if the target assembly 10 is located at a relatively far distance. As shown in FIG. 5, the hit ball 40 is approaching the target 12. Finally, the ball 40 passes through one of the openings 14 to hit a lower portion of the curved surface of the target 12 in the base assembly 11 as shown in FIG. 6. A pleasing sound can be heard when a center of the ball 40 struck the lower portion of the curved surface of the target 12. Also, the target 12 vibrates for visually signaling a hit. The person may have a feeling of satisfaction after seeing the vibration of the target 12 and hearing the pleasing sound.

The golf training kit enables a person to enjoy as much recreation as playing golf on an outdoor large course. Further, it is highly adaptable to limited environment and it is designed to enable most ordinary people to frequently engage in golf playing by spending only a small amount of money. Moreover, its playing is convenient and time saving for tailoring the needs of busy people. Thus, the invention can remedy the foregoing and other deficiencies inherent in golf playing.

While the invention herein disclosed has been described by means of specific embodiments, numerous modifications and variations could be made thereto by those skilled in the art without departing from the scope and spirit of the invention set forth in the claims.

What is claimed is:

1. A golf training device for playing on a small course, comprising:

a golf club;

a golf ball, and a target assembly comprising a base assembly of a predetermined height and including a plurality of peripheral openings, a support on a top of the base assembly, and a hollow target hung under the support, wherein the target in response to being struck by the golf ball driven by the golf club through one of the openings;

wherein the target is a cuplike member and the cuplike member is a bell having a curved surface on its lower portion; and wherein the bell comprises a top aperture and a threaded shank passed through the aperture and the support, the target assembly further comprising a sleeve either formed separately from the support or formed integrally therewith, the sleeve including inner threads threadedly secured to the shank passed through the aperture.

2. The golf training device of claim 1, wherein the shank comprises a bottom enlargement urged against a bottom of the aperture.

3. The golf training device of claim 2, wherein the enlargement has a diameter larger than that of the aperture.

4. The golf training device of claim 1, wherein the aperture has a diameter larger than that of the shank.

5. The golf training device of claim 1, wherein the sleeve further comprises outer threads.

* * * * *